US005375489A

United States Patent [19]

McClure

[11] Patent Number: 5,375,489

[45] Date of Patent: Dec. 27, 1994

[54] SELF-LOCKING UNIVERSAL SOCKET TOOL

[76] Inventor: Travis McClure, 16817 10th Ave. W., Apt A 204, Lynnwood, Wash. 98037

[21] Appl. No.: 989,154

[22] Filed: Dec. 11, 1992

[51] Int. Cl.[5] ..... B25B 13/12

[52] U.S. Cl. ..... 81/128; 279/65; 279/74

[58] Field of Search ..... 81/128, 532; 279/60, 279/65, 74, 56

[56] References Cited

U.S. PATENT DOCUMENTS

| | | | |
|---|---|---|---|
| 1,155,662 | 10/1915 | Kleisteuber . | |
| 2,476,874 | 7/1949 | Johansson . | |
| 2,565,212 | 8/1951 | Drazick . | |
| 2,599,026 | 6/1952 | Strayer . | |
| 2,764,050 | 9/1956 | Leibowitz . | |
| 3,373,639 | 3/1968 | Van Dalen et al. . | |
| 3,719,110 | 3/1973 | LaPointe . | |
| 4,213,355 | 7/1980 | Colvin | 81/128 |
| 4,235,134 | 11/1980 | McLendon . | |
| 4,374,481 | 2/1983 | Brodie . | |

*Primary Examiner*—James G. Smith

[57] ABSTRACT

An automatically adjustable socket transferring torque a range of bolt heads sizes in either direction comprises a pair of jaws slidable angled to a center cylinder and urged outward to a receiving position so that when the socket is set upon a bolt head the bolt head impresses the jaws towards the center cylinder, angularly so that the jaws maintain a parallel orientation to the bolt head faces. An upper cylinder and a lower cylinder surrounding the center cylinder each having complementary double arch rims interact as torque is applied to the upper cylinder, first to separate the two cylinders the bottom cylinder further impressing the jaws upon the bolt head until the jaws are maximally closed upon the bolt head the double arch rims then providing a torque transfer means from the upper cylinder to the lower cylinder. The lower cylinder transfers torque to the jaws through torque transfer surfaces to the jaws tangential to the bolt head. The invention also contemplates adapting jaws gripping surfaces to transfer torque to other configurations of objects to be torqued and adapting the socket to different sources of torque.

6 Claims, 4 Drawing Sheets

SELF-LOCKING UNIVERSAL SOCKET TOOL

BACKGROUND OF THE INVENTION

1. Field of the Invention

The present invention generally relates to gripping devices and, more particularly, to self-locking gripping device which can adjust itself to a variety of objects to be torqued, compressively, grasp the object then transfer torque, in either direction. This invention is ideally suitable to be used in the area of torque tools, such as rachet tools and tool chucks in a variety of applications, such as in conjunction with various size drill bits, lathe applications and the like.

There are many examples where applications of torque is necessary. For example, an object to be lathed is set into a lathe chuck, the chuck is then tighten and then torque is applied. After the torquing operation, the object is then released from the chuck and the lathe is available for the next object to be torqued. Other popular examples include drilling: a drill bit is set into a drill chuck, the drill chuck is then tightened to firmly grasp the drill bit and then torque is applied to the bit. After the torquing operation, the drill bit is removed by releasing the drill bit to make the drill bit available for the next size bit. Another very popular torque application is in the field of bolt torquing.

2. Brief Description of the Prior Art

A need has existed for a tool which is durable and allows for the quick and effective gripping and torquing of objects, such as bolt heads of any size. An examination of prior attempts to fill the need demonstrate the usefulness, novelty, and non-obviousness of the present invention.

In the field of bolt torquing: a common device known to many is the traditional standard set of sockets. A series of sockets of varying, standard sizes is provided to interact with a standard size driving ratchet, a handle with a standard size rachet prong, usually having a square cross-section with locking ball. The standard socket sets are used by matching a particular size socket to be used in conjunction with a particular size bolt head, as each socket will fit a bolt of only a particular size head. Moreover, because bolts are commonly either metric sized or English sized, there is the need to have a complete set of both metric and English sockets to be able to torque any bolt. Such sets are cumbersome as one must often try a variety of sockets before finding the right sized socket for the job. Additionally, the socket sets are bothersome to store, the sockets in the different standard sets often are misplaced, and require care to maintain in an orderly fashion; furthermore, the particular sockets are easily lost or misplaced. Because of standardization, standard size sockets are little or no use for an off standard sized bolt caused by bolts made of poor quality, either in size or in material or by changes in bolt sizes due to re-standardization. Further, standard size sockets may not work with bolt heads which are worn or improperly sized. The standard set of sockets in this case would have a socket either too small to fit onto the bolt head or too large to be able to grasp the bolt head.

Several adjustable socket designs attempt to address these problems. For instance, several adjustable socket designs often require that one use both hands to secure their socket tool onto a bolt head before it can interface the tool with a ratchet. These sockets have no means to automatically adapt to the bolt head nor do they have any means to insure that the jaws remain parallel to impart torque. Other designs rely on a power screw configuration to create adaptation and apply torque. However, such designs often require the tool to travel through several rotations and these designs are unidirectional. Still other designs often use adjustable jaws that are pined about a pivot point to grip the bolt head. This creates several problems. First, the pivot rotation about these pins cause the griping surface of the jaws to be angularly oriented from the faceted surfaces of the bolt head thus creating contact stress on the bolt head limiting torque transfer to a portion of the bolt head or deform the bolt head. In addition, adjustable pivoted arms are inherently weak since the torque that can be applied is limited by the strength of the pivot points. If greater strength is desired, the design requires up scaling the parts to where the tool may be so large that it will not be practical to use.

Other attempts to create a truly universal tool to solve these problems have also failed. For example, adaptable tool for gripping and torquing a variety of bolt heads of different sizes can be seen in Kleinsteuber, U.S. Pat. No. 1,155,662 which teaches a clamping device requiring the manual insertion of a stud into the jaws of the clamping device before beginning the torquing process. This tool requires screw tightening a stud into the head of the tool so that gripping surfaces can fit the bolt head to permit the transfer of torque. Likewise, Johansson U.S. Pat. No. 2,476,874 shows a grip chuck requiring manual twisting of a jamb nut about a collet in order to tighten the collet about the work piece before torquing.

Other tools designed provide for automatic sizing of the tool to a bolt head but fail to protect the grasping means from a torque induced bending mode. This problem can easily be understood when a pair of pliers is used to torque a bolt head from above the bolt head along the axis of rotation, from above. While the plier jaws can be sized to grasp the bolt head (albeit the jaw surface at an angle to the bolt head surface) the plier jaws will tend to bend and deform as torque is applied to the bolt head. Further, some tools also provide for imperfect contact or grip of the gripping means to the bolt head thereby failing to provide maximum torque should the bolt heads be worn or of imperfect size. For example, Van Dalen et al U.S. Pat. No. 3,373,639 and Strayer U.S. Pat. No. 2,599,026 teach tools which use resiliently deflectable jaws and resilient fingers, respectively, to grip a bolt head. These tools fail to address the bending mode problem of the grasping means when the tool torques the bolt.

As can be seen in other examples of prior art, applying torque in one rotational direction may not be the same as applying torque in the other rotational direction due to the lack of symmetry of the elements within the tool. For example, applying torque in the common drill chuck or lathe chuck will tend to increase grip upon the drill bit or object to be torqued in one rotational direction and tend to loosen the grip upon the drill bit or object to be torqued in the other rotational direction.

BRIEF SUMMARY OF THE INVENTION

My invention has the advantage of having internal symmetry so that it will work exactly the same in either rotational direction. This permits torque to be applied in either rotational direction with the feature of application of compressive grasping to the object to be torqued and then the application of applying maximum torque transferred to the object to be torqued. For the purposes of the explanation as to the manner in which my invention operates, I shall refer to a bolt head as the object to be torqued, however it should be understood that my invention is not limited to only this object. It should be considered within the scope of my invention that any object to be torqued could be substituted for the exemplified bolt head, the application of the principles of my invention being applied in any of the other areas where torquing is used.

My invention has a set of jaws with grasping means slidable fixed to the working end of a center cylinder with angled or skewed guides. While my example has two jaws, it is obvious that the number of jaws can be increased to any number which can conveniently fit in the area to be described below. The center cylinder sits within an upper annular section and a lower annular section. The upper and lower annular sections have conforming double arches which interact in the following way: when the upper annular section begins to turn, resistance of the jaws onto the bolt head fixes the lower annular section. Further torque of the upper annular section causes the lower annular section to separate away from the upper annular section. As the lower annular section separates, the bevelled portion of the near edge of the lower annular section compresses the jaws upon the bolt head thereby compressing the bolt head further. At some point, the interaction of the conforming double arches will begin to transfer torque from the upper annular section to the lower annular section. It should be noted that torque transfer surfaces at the working edge of the lower annular section slidable interact with the outside surface of each jaw. This torque transfer surface transfers torque tangentially from the lower annular section to the jaws preventing a bending mode of the jaws and skewed guides, as this torque is applied to the bolt head. It is also noted above that because of symmetry of the double arches on the upper and lower annular sections, the invention operates in this manner in either rotational direction.

It should also be noted that the jaws described above are slidable locked at an angle or in a skewed manner with the jaw guides such that the grasping surfaces of the jaws will always maintain a parallel relationship to the bolt head as the jaws emerge or retreat from the center cylinder. Nibs on the guides and a pin lock, slidable fix the jaws to the center cylinder. Once set, a spring between the center cylinder and the jaws urge the jaws to a maximum open position when in the relaxed mode.

It should be further noted that in use, the tool is first inserted over the bolt head, the bolt head urging the jaws against the spring pressure into the cylinder to set the jaws around the bolt head as the jaws are angularly guided into the inner cylinder. At this point the jaws are set onto the bolt head and the bolt head can be torqued as described above. When torquing has stopped the bolt head is no longer compressed by the interaction of the double arches and the jaws are only set about the bolt head which can be removed from the jaws with the assistance of the spring.

My tool is designed such that it can be disassembled for cleaning, or easily reconfigured such that the torque receiving rachet adapter can be substituted for different size rachet prongs, Likewise, my invention permits the jaw grip surfaces to be exchanged for other jaw grip surfaces relating to the approximate configuration of the object to be torqued. In this manner, the jaws and the ratchet interface system can be changed such that the tool is available to operate on any other type or range of sizes of bolt. My tool is easy to use while being small, elegant and structurally strong. My tool has the means to automatically adjust its geometry, apply torque in either rotational direction, and return automatically to a set position whenever torque ends.

Therefore, in general, an object of my invention is to provide for a quick and convenient means for adapting to and applying torque to various sizes of objects to be torqued.

Another object of my invention is to provide a functionally superior tool to transfer torque to an object which can adapt over a range of different sizes and configurations which will automatically adjust to a wide variety of fastening means.

A further object of my invention is to provide a transfer torque tool which works equally in either rotational direction.

Still, another object of my invention is to provide a universal, self-locking tool which will provide a maximum amount of torque transfer in conjunction with a variety of different size bolt-heads, worn or deformed bolt-heads by providing a adjustable grasping means and torque application closely tangential to the bolt head thereby reducing or eliminating the bending mode.

A further object of my invention is to provide a universal, self locking tool which compressively and firmly grasps a bolt head parallel to the facets of the bolt head as well as to the angle corners of the bolt head to minimize possibility of slipping due to imperfect bolt heads.

A still another object of my invention is to provide a maximum contact area between the bolt head area and the grasping means to permit torque to be applied along a large area of the bolt head.

Another object of my invention is to provide a tool which can be used in a variety of applications where torque need be applied to non-standard objects in applications where the object to be torqued can be quickly and safely grasped and torqued in either direction, and after the torquing process, the object can be quickly and safely released.

Another object of my invention is to provide a tool with the advantages expressed above capable of being easily adaptable to a variety of torque sources and configurations of objects to be torqued.

DESCRIPTION OF THE PREFERRED EMBODIMENTS

Figure 1:
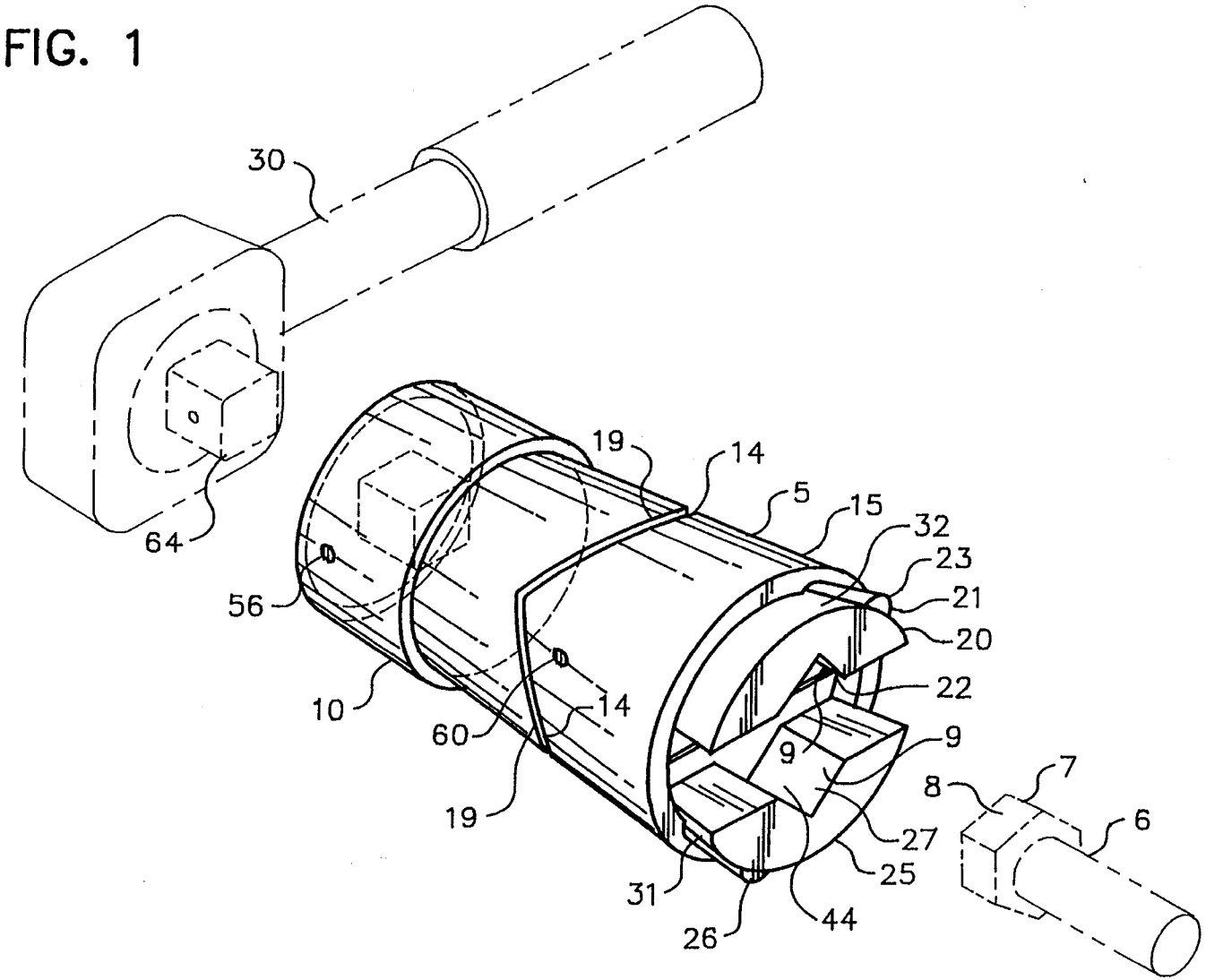
FIG. 1 is a perspective view of the device.

Proceeding to describe the invention in detail reference should first be made to the drawings by numeral of reference and more particularly to FIG. 1, there is shown a self-locking universal socket tool 5, a bolt 6 with bolt head 7, an upper annular section 10, a lower annular section 15 and a pair of jaws 20 and 25. The annular sections 10 and 15 may be configured according to this specification from hardened steel tubing of appropriate size as is common in tool manufacturing.

Figure 2:
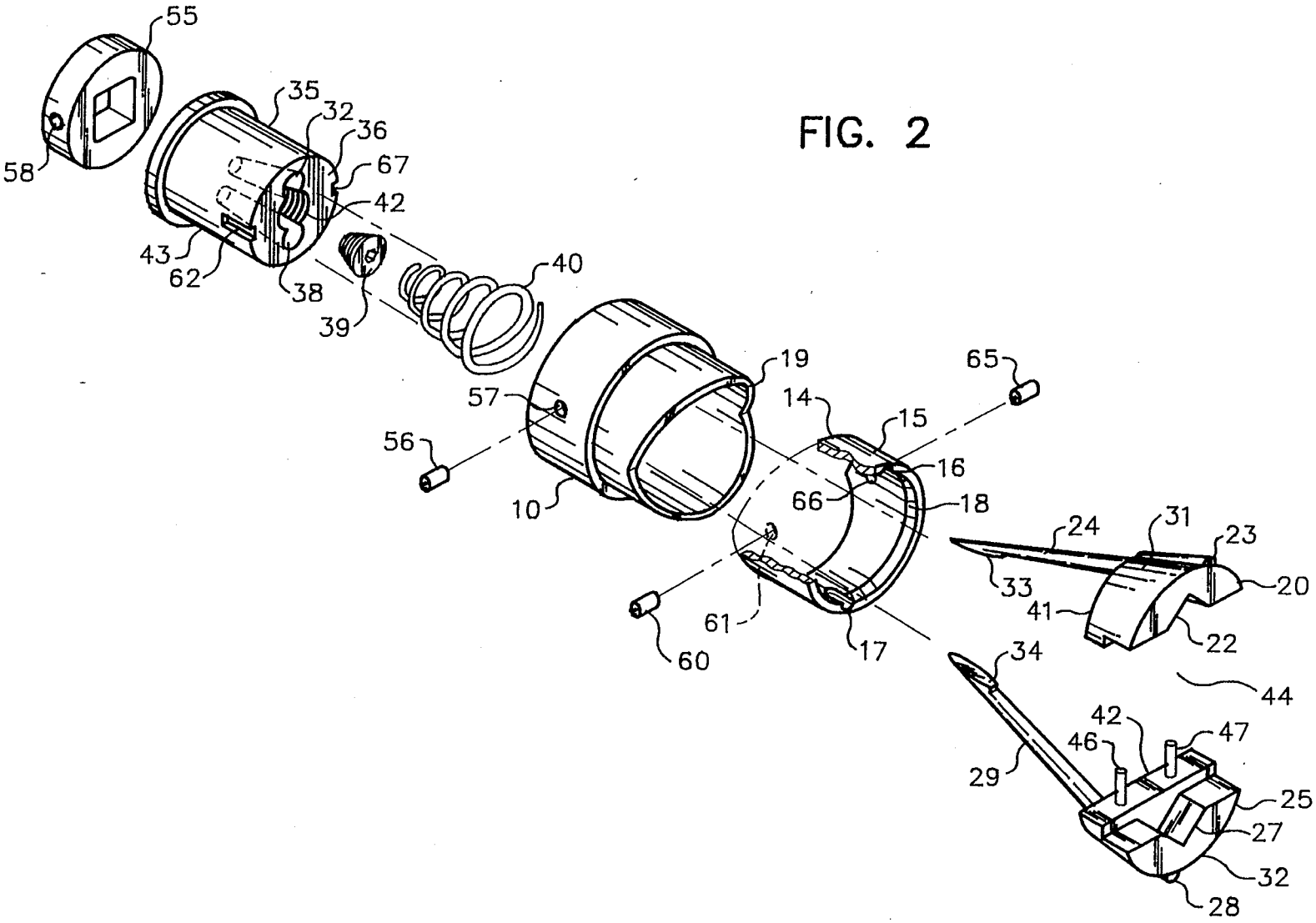
FIG. 2 is an exploded perspective view of the device.

Referring to FIG. 2, on the outside of each of the jaws 20, 25 are shown torque transfer means 21 and 26, shown here as semi rounded cylinders. These torque transfer means 21 and 26 consist of pins 23 and 28 which have been fit into semi-cylinder recesses (not shown) cut into the outer surfaces of the jaws 20 and 25. These torque transfer means 21 and 26 track within recesses 16 and 17 at the bevelled edge 18 of the lower annular section 15 as the jaws 20 and 25 open to the relaxed mode and close to the torqued mode. With this configuration, torque is transferred from the lower annular section 15 to the pair of jaws 20 and 25 without creating a significant bending mode within the jaws 20, 25 in the torqued mode at the same time, the jaws are permitted to slide freely outward, as the Tool 10 is shown in the relaxed mode, in FIG. 3. The bevel edge 18 of the jaws end of the lower annular section facilitates the linear movement of the jaws 20 and 25 with respect to the lower annular section. In the relaxed mode, shown in FIG. 3, the jaws are extended in a maximum amount from the working end 36 of the inner cylinder 35. The jaws are urged open in the relaxed mode by an extending coil spring 40 seated between the working end 36 of the inner cylinder 35 and the seats 41 and 42 located on the inner surface of the jaws 20 and 25.

The outside portion 31 and 32 of each jaw 20 and 25 is rounded to conform to the round configuration of inside of the bevelled edge 18 of the lower annular section is inner and skewed with respect to the outside surface 43 of the inner cylinder 35. Guides 24, 29 extend from the rounded outside surfaces 31 and 32 and skewed in the same respect as the outside surfaces 31 and 32 and mate into matching skewed recesses 37 and 38, respectively. The guides 24 and 29 are prevented from exiting the recesses 37 and 38 by nibs 33 and 34 when lock screw 39 is set into center recess 42. In this manner both jaws 20 and 25 are slidable movable in an angular fashion defined by the skewed guides to open or close the bolt-head receiving space 44, shown generally within the jaws 20 and 25. Jaw guide pins 46 and 47 communicating between jaws 20 and 25 with matching jaw guide recesses (not shown) assure that the jaws slide together in a cooperating configuration. The slidable skewed feature of the jaws permits the facets 9 of the indentations 22 and 27 of the jaws to remain at all times parallel to each other and impress the facets 8 of the bolt head along the entire surface of the respective facets instead of along only a portion of the surfaces. The bevel edge 18 of the rim of the lower annular section facilitates this slidable movement of the jaws 20 and 25 and eliminates what would be a corner pivot support edge at the end of the lower annular section. The bevel edge 18 provides a larger support surface for the jaws 20 and 25.

The bolt head 7 shown here has a standard hexagonal configuration, however, considering the fact that the jaws 20 and 25 may be cut with indentations 22 and 27 to conform to the any shape of bolt head 7, the fact that the shape shown here is hexagonal should not limit my invention to only this shape. In practice, my invention may match any standard configured set of bolt head shapes other than hexagonal, such as quadrangular, pentagonal and others by appropriate configuration of the facets 9 of the indentations 22, 27 of the jaws 20, 25.

Referring to FIG. 1, a socket wrench outlined as 30 idealizes a torque source, however, my invention may be torqued by a variety of torque sources, such as the socket wrench 30 outlined here or a power wrench assembly, a solid or jointed rachet wrench or other common torquing tools such as used in work shops.

Referring to FIG. 2, rachet adapter 55 having recess sits 58 within the far portion of the upper annular section 10 and held by a lock pin 56 through hole 57 in the upper annular section 10 and hole 58 of the rachet adapter 55. While this is one method of transferring torque from a torque source, such as rachet wrench 30, any method of transferring a torque source to the upper annular section 10 would be acceptable since the tool works whenever the upper annular section 10 is torqued. But it should be pointed out that the particular feature of a removable rachet adapter as shown by this embodiment has the advantage of permitting the rachet adapter to be changed so that different size rachet sizes may be quickly replaced by removing the pin 56, removing the old rachet adapter 55 and replacing the rachet adapter 55 with a rachet adapter having a rachet recess 59 of a different size. For example, this feature would permit the tool to be used in conjunction with different size rachet prongs 64, such as one half inch, one quarter inch, three-eight inch prongs, etc. Likewise, the tool could be used in conjunction with hexagonal or other configuration torquing means.

Keyway alignment pin 60, connects through hole 61 on the lower annular section into slot 62 provided on the surface of inner cylinder 35. Likewise, a second keyway pin 65, connects through hole 66 on the lower annular section into slot 67 of the inner cylinder 35. These keyway pins align the lower annular section 15 with the inner cylinder 35 to insure that the torque transfer surfaces 21 and 26 of jaws 20 and 25 match recesses 16 and 17.

As shown in FIG. 1 and FIG. 2, the near rim 19 of the upper annular section 10 is configured in a double arch. Likewise and in complementary form, the far rim 14 of the lower annular section 15 is also configured in a double arch. In this manner, as the upper annular section 10 is torqued, there is a tendency of the lower annular section 15 to separate from the upper annular section 15 by the cooperation of the complementary double arches 19 and 14.

Figure 3:
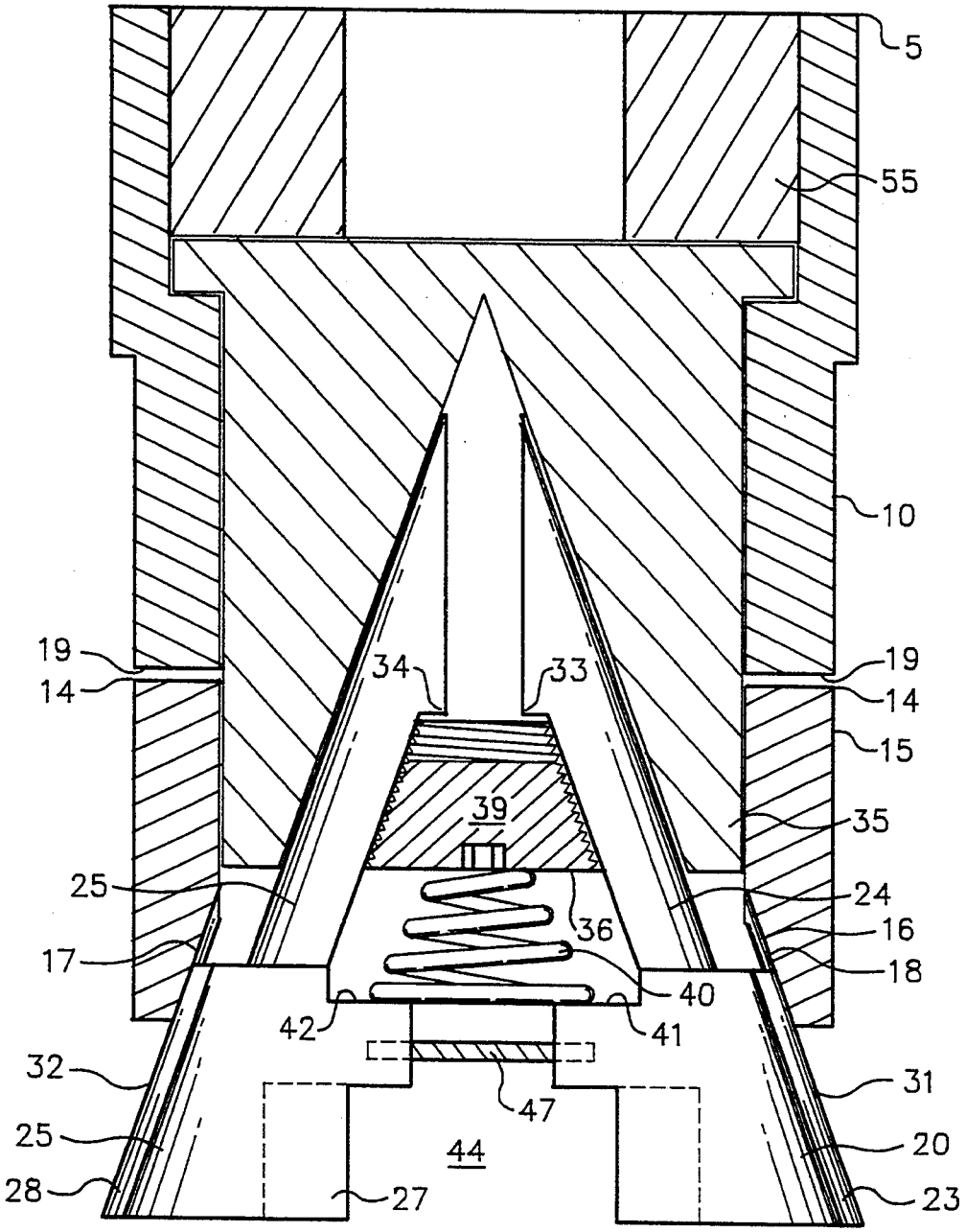
FIG. 3 is a side elevation sectional view of the device in the relaxed mode.

In use, the tool in the relaxed mode as described in FIG. 3 is set by impressing a bolt head in the bolt head receiving space 44. As the tool is impressed upon the bolt head, the top of the bolt head urges the jaws 20 and 25 inward into the center cylinder 35 against the urging of the spring 40 also closing the jaws 20 and 25 around the bolt head by action of the skewed guides setting into the skewed or angled recesses 24 and 25.

Figure 4:
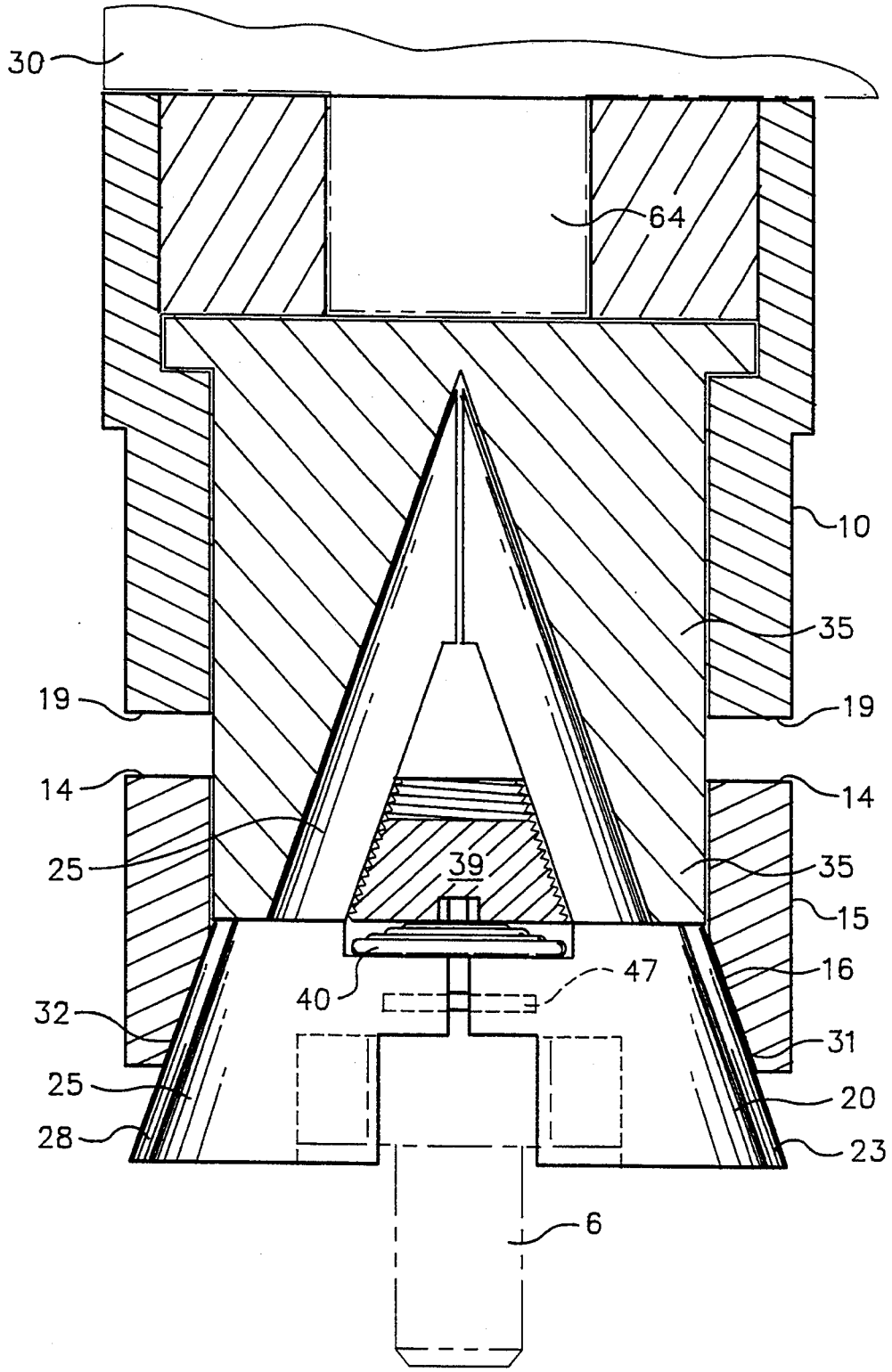
FIG. 4 is a side elevation sectional view of the device in the torqued mode.

Referring to FIG. 4, after a bolt head 7 is set torque can then be applied, in either direction. This does two things. The cooperation of the double arch configurations of the two rims 14 and 19 has the effect of first compressing the facets 9 of the jaws to lock onto the facets 8 of the bolt head. When the jaws are locked upon the bolt head, the bolt head stopping the jaws, the complementary double arches 19 and 14 then become torque transfer means, imparting torque from the upper annular section 10 to the lower annular section 15 by interaction of the complementary double arches 14 and 19, now partially separated. This is shown in FIG. 4.

After fully describing the invention, what is claimed is:

1. A self-locking universal tool which grips a item to be torqued and transfers torque in either direction comprising:

an upper annular section having a double arched rim and a means to receive torque; said double arched rim being non-planer, varying continuously from a maximum extension to a minimum extension twice around the perimeter of said rim;

a lower annular section having a double arched rim adjacent and complementary to the double arched rim of the upper annular section, the sections tending to separate and to transfer torque from the upper annular section to the lower annular section by the cooperation of the double arched rims whenever the upper annular section is torqued with respect to the lower annular section in either rotational direction;

an inner cylinder seated within the upper annular section and the lower annular section;

a plurality of jaws, each jaw held slidable outward in an angular fashion from a working end of the inner cylinder;

a torque transfer means to transfer torque from the lower annular section to the jaws;

a means to urge the jaws open from a working end of the inner cylinder, the item to be torqued urging the jaws to close as the item to be torqued urges the jaws towards the inner cylinder said jaws closing about the item to be torqued;

the item to be torqued grasped by the jaws as the upper annular section is torqued, the lower annular section separating from the upper annular section until the jaws are fully locked, torque transferring from the upper annular section through the lower annular section and the jaws applied tangentially to the item to be torqued.

2. A self-locking universal tool which grips an item to be torqued and transfers torque at a working end in either direction comprising:

An upper annular section having a double arched near rim with respect to a working end and a torque receiving means on a far end with respect to the working end;

A lower annular section having a double arched far rim with respect to the working end adjacent and complementary to said double arched near rim of the upper annular section and an inner beveled rim with longitudinal torque transfer recesses located at a near edge with respect with respect to the working end;

An inner cylinder having a center lock recess, a plurality of skewed jaw guide recesses on a near end, a slidable means to maintain the inner cylinder aligned within the lower annular section;

A plurality of jaws, each jaw extending from said jaw guide recesses by an elongated matching skewed jaw guide with an end nib, the jaw held into the skewed jaw guide recesses by a center lock screw seated into the center lock recess, each nib preventing its jaw guide from exiting its jaw guide recesses while permitting skewed movement of the jaw therein, the skewed jaw guide sliding upon the beveled rim of the near edge of the lower annular section, each jaw having jaw indentations conforming to the item to be torqued, each jaw having a torque guide adjacent to the indentations of each jaw conforming to said torque transfer receives located at the near edge of said lower annular section;

An urging means to maintain maximum extension of said jaws from the inner cylinder in a relaxed mode and compressed whenever the item to be torqued impresses the jaws into a torquing mode, the amount compressed determined by the size of the item to be torqued, torque applied to the upper annular section in either rotational direction causing the double arch near rim of the upper annular section to rotate with respect to the double arch far rim section of the lower annular section, the lower annular section separating from the upper annular section, the jaws held therein being impressed by the linear movement of the bevelled rim, torque also being transferred to the lower annular section by means of the complementary double arch rims through the torque transfer recesses and torque guides on the skewed jaws to the item to be torqued.

3. A self-locking universal tool which grips an item to be torqued and transfers torque in either direction as described in claim 2 further comprising a means to maintain cooperation between the jaws.

4. A self-locking universal tool which grips an item to be torqued and transfers torque in either direction as described in claim 3 wherein said means to maintain cooperation between the jaws comprises a pair of alignment pins slidable interconnecting said jaws.

5. A self-locking universal tool which grips an item to be torqued and transfers torque in either direction as described in claim 1 wherein said means to receive a torque force comprises a rachet adapter with an interchangeable center recess capable of receiving and interchanging standard rachet configurations.

6. A self-locking universal tool which grips an item to be torqued and transfers torque in either direction as described in claim 1 wherein said urging means comprises a coil spring seated between the working end of the inner cylinder and each jaw.

* * * * *